US008897456B2

(12) United States Patent
Sohn et al.

(10) Patent No.: US 8,897,456 B2
(45) Date of Patent: Nov. 25, 2014

(54) METHOD AND APPARATUS FOR ESTIMATING SPECTRUM DENSITY OF DIFFUSED NOISE

(75) Inventors: Jun-il Sohn, Yongin-si (KR); Yun-seo Ku, Seoul (KR); Dong-wook Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 323 days.

(21) Appl. No.: 13/426,706

(22) Filed: Mar. 22, 2012

(65) Prior Publication Data

US 2012/0243695 A1 Sep. 27, 2012

(30) Foreign Application Priority Data

Mar. 25, 2011 (KR) ..... 10-2011-0027178

(51) Int. Cl.
*H04R 29/00* (2006.01)
*H04R 25/00* (2006.01)
*H04R 3/00* (2006.01)

(52) U.S. Cl.
CPC ..... *H04R 25/407* (2013.01); *H04R 2499/11* (2013.01); *H04R 2460/03* (2013.01); *H04S 2420/01* (2013.01); *H04R 3/005* (2013.01); *H04R 25/552* (2013.01)
USPC ..... 381/56; 381/66; 381/71.1; 381/92; 381/98; 455/570; 379/406.01; 704/E21.002

(58) Field of Classification Search
CPC ..... H04S 1/00; H04S 1/002; H04S 1/005; H04S 1/007; H04S 7/301; H04S 7/305; H04S 7/306; H04S 7/307; H04S 2400/09; H04S 2400/15; H04S 2420/07; H04S 2420/11; H04S 2420/13; H04R 2225/43; H04R 2227/007; H04R 2227/009; H04R 2410/01; H04R 2410/05; H04R 2420/07; H04R 2430/03; H04R 2460/01; H04R 2410/03; H04R 2410/07; H04R 2225/021; H04R 2225/023; H04R 2225/025; H04R 2225/49; G10L 19/03; G10L 21/02; G10L 21/038; G10L 21/0388; G10L 21/0308; G10L 25/18; G10L 25/06; G10L 25/21; G10L 25/24; G10L 2021/02; G10L 2021/0208; G10L 2021/02082; G10L 2021/02085; G10L 2021/02087; G10L 2021/0216; G10L 2021/02165; G10L 2021/02166; G10L 2025/937; G10L 2025/932
USPC ..... 381/56, 57, 23.1, 320, 321, 317, 61, 66, 381/71.9, 71.11, 71.12, 71.14, 92, 94.1, 381/94.2, 94.3, 94.7, 97, 98, 100, 103; 704/E19.013, E21.002, E21.007; 379/406.01, 406.06, 406.11, 406.12, 379/406.13, 406.14; 455/570; 700/94
See application file for complete search history.

(56) References Cited

U.S. PATENT DOCUMENTS

2003/0147538 A1* 8/2003 Elko ..... 381/92
2008/0130914 A1* 6/2008 Cho ..... 381/94.1

(Continued)

FOREIGN PATENT DOCUMENTS

JP 2010-200350 A 9/2010
KR 10-2010-0053890 A 5/2010
KR 10-2010-0120567 A 11/2010

OTHER PUBLICATIONS

Arslan, Levent, et al. "New methods for adaptive noise suppression." 1995 International Conference on. vol. 1. IEEE (1995): 812-815.

(Continued)

*Primary Examiner* — Leshui Zhang
(74) *Attorney, Agent, or Firm* — NSIP Law

(57) ABSTRACT

Provided are a method for estimating a spectrum density of diffused noises. Also provided is a processor for implementing the method. The processor includes at least two sound receiving units and a spectrum density estimating unit for estimating spectrum density.

15 Claims, 3 Drawing Sheets

(56) References Cited

U.S. PATENT DOCUMENTS

| | | | |
|---|---|---|---|
| 2009/0012783 | A1 | 1/2009 | Klein |
| 2010/0208921 | A1 | 8/2010 | Fischer |

OTHER PUBLICATIONS

Hirsch, H. G., et al. "Noise estimation techniques for robust speech recognition." 1995 International Conference on. vol. 1. IEEE (1995): 153-156.

Martin, Rainer. "Noise power spectral density estimation based on optimal smoothing and minimum statistics." Speech and Audio Processing, IEEE Transactions on vol. 9 No. 5 (2001): 504-512.

McCowan, Iain A., et al., "Microphone array post-filter based on noise field coherence." Speech and Audio Processing, IEEE Transactions vol. 11 No. 6 (2003): 709-716.

Abutalebi, Hamid Reza, et al. "A hybrid subband adaptive system for speech enhancement in diffuse noise fields." Signal Processing Letters, IEEE vol. 11 No. 1 (2004): 1-4.

* cited by examiner

METHOD AND APPARATUS FOR ESTIMATING SPECTRUM DENSITY OF DIFFUSED NOISE

CROSS-REFERENCE TO RELATED APPLICATION(S)

This application claims the benefit under 35 USC §119(a) of Korean Patent Application No. 10-2011-0027178, filed on Mar. 25, 2011, in the Korean Intellectual Property Office, the entire disclosure of which is incorporated herein by reference for all purposes.

BACKGROUND

1. Field

The following description relates to a processor and method for estimating spectrum density of diffused noise.

2. Description of the Related Art

Typical methods for removing noises from audio apparatuses include valley detection, histograms, and the like. However, a portable audio apparatus has a limited battery capacity. Accordingly, a limited amount of algorithm calculations may improve battery life.

SUMMARY

In one general aspect, there is provided a processor including at least two sound receiving units configured to receive sounds, a correlation estimating unit configured to estimate a correlation between diffused noises included in the sounds received by the at least two sound receiving units, and a spectrum density estimating unit configured to estimate a spectrum density with respect to the diffused noises based on the estimated correlation.

The spectrum density estimating unit may be configured to estimate the spectrum density in which a low frequency band is compensated.

The spectrum density estimating unit may comprise an eigenvalue estimating unit configured to estimate an eigenvalue of a covariance matrix based on the sounds received by the at least two sound receiving units, and a low frequency band compensating unit configured to compensate a low frequency band of spectrum density with respect to the diffused noises based on the estimated eigenvalue and the estimated correlation.

The covariance matrix may comprise elements including the estimated correlation multiplied by the power spectrum density of the diffused noises.

The correlation estimating unit may estimate the correlation between diffused noises included in the sounds received by the at least two sound receiving units, such that a higher weight is applied to a low frequency band of the diffused noises in comparison to a high frequency band of the diffused noises.

The correlation estimating unit may be configured to estimate the correlation using a sinc function according to a frequency.

The correlation estimating unit may be configured to estimate the correlation using sinc functions according to the frequency and a distance between the at least two sound receiving units.

The processor may further comprise a noise removing unit configured to remove the diffused noises included in the sounds received by the at least two sound receiving units using the estimated spectrum density.

In another aspect, there is provided a sound reproducing device including a processor configured to receive sounds using at least two sound receiving units, to estimate a spectrum density with respect to diffused noises included in the received sounds in consideration of correlation between the diffused noises, and to remove the diffuses noises included in the received sounds based on the estimated spectrum density, an amplifying unit configured to amplify the sounds from which the diffused noises are removed, and an output unit configured to output the amplified sounds.

The estimated spectrum density may be a spectrum density in which a low frequency band is compensated.

The sound reproducing device may be a binaural hearing aid.

In another aspect, there is provided a method for estimating spectrum density of diffused noises using a device that has at least two sound receiving units, the method including receiving sounds by the at least two sound receiving units, estimating a correlation between diffused noises included in the sounds received by the two sound receiving units, and estimating a spectrum density with respect to the diffused noises based on the estimated correlation.

The estimating of the spectrum density may comprise estimating the spectrum density in which a low frequency band is compensated.

The estimating of the spectrum density with respect to diffused noises may comprise estimating an eigenvalue of a covariance matrix using the sounds received by the at least two sound receiving units, and estimating the spectrum density in which a low frequency band is compensated based on the estimated eigenvalue and the correlation between the diffused noises.

The covariance method may comprise elements including the estimated correlation multiplied by power spectrum density of the diffused noises.

The estimating of the correlation may comprise estimating the correlation between the diffused noises included in the sounds received by the at least two sound receiving units, such that a higher weight is applied to a low frequency band of the diffused noises in comparison to a high frequency band of the diffused noises.

The estimating of the correlation may comprise estimating the correlation using a sinc function according to a frequency.

The estimating of the correlation may comprise estimating the correlation using sinc functions according to the frequency and a distance between the at least two sound receiving units.

The method may further comprise removing the diffused noises included in the sounds received by the at least two sound receiving units using the estimated spectrum density.

In another aspect, there is provided a computer-readable storage medium having stored therein program instructions to cause a computer to execute a method for estimating spectrum density of diffused noises using a device that has at least two sound receiving units, the method including receiving sounds using the at least two sound receiving units, estimating a correlation between diffused noises included in the sounds received by the two sound receiving units, and estimating a spectrum density with respect to the diffused noises based on the estimated correlation.

Other features and aspects may be apparent from the following detailed description, the drawings, and the claims.

Figure 1:
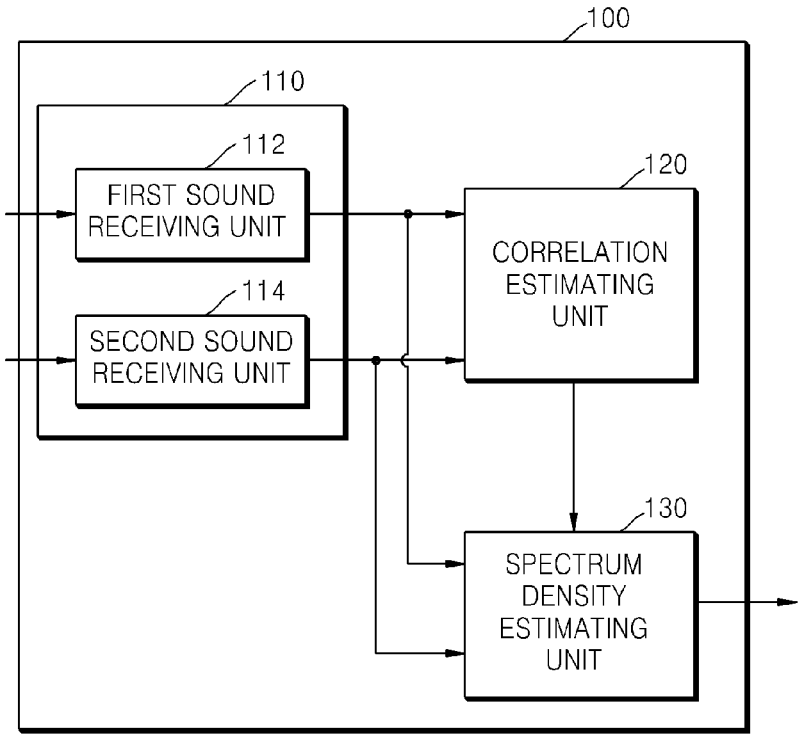
FIG. 1 is a diagram illustrating an example of a processor which performs estimation of spectrum density of diffused noise.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

FIG. 1 illustrates an example of a processor 100 which performs estimation of spectrum density of diffused noise. In various examples, the processor 100 may include a plurality of processors.

Referring to FIG. 1, the processor 100 include at least two sound receiving units 110, a correlation estimating unit 120, and a spectrum density estimating unit 130. In this example, the at least two sound receiving units 110 includes a first sound receiving unit 112 and a second sound receiving unit 114. In FIG. 1, the processor 100 may further include additional general purpose components other than the components shown in FIG. 1.

For example, the processor 100 shown in FIG. 1 may be embodied as an array of a plurality of logic gates or a combination of a general purpose microprocessor and a memory unit having stored therein a program to be executed by the microprocessor.

The processor 100 may be used to estimate a spectrum density with respect to diffused noise based on sound received from the surroundings. The processor 100 may be included in devices including a sound reproduction device, a sound outputting device, a repeater, a telephone, a communication device, a sound detector, binaural hearing aids, and the like. For example, the processor may be included in a terminal, a mobile phone, a computer, a sensor, a hearing aid, and the like.

The at least two sound receiving units 110 receive sound from the surroundings. In the example of FIG. 1, the processor 100 includes two sound receiving units. However, it should be appreciated that the processor 100 may include one sound receiving unit, two sound receiving units, or more sound receiving units. For example, the sound receiving units 110 may further include a third sound receiving unit (not shown), a fourth sound receiving unit (not shown), and so on.

The sound receiving units 110 may be microphones that receive sound from the surroundings and convert the sound to electric signals. As another example, the sound receiving units 110 may include any of various devices which detect and receive sound from the surroundings.

In an example in which the processor 100 is included in a binaural hearing aid, the first sound receiving unit 112 and the second sound receiving unit 114 may be worn in correspondence to the right ear and the left ear of a user, respectively.

The correlation estimating unit 120 may estimate correlation between diffused noises that are included in sounds received by the sound receiving units 110. For example, a first diffused noise may be included in a first sound received by the first sound receiving unit 112 and a second diffused noise may be included in a second sound received by the second sound receiving unit 114. The correlation estimating unit 120 may estimate a correlation between the first diffused noise and the second diffused noise.

For example, the same sound may be included in the first sound and the second sound received by the first sound receiving unit 112 and the second sound receiving unit 114. Furthermore, diffused noises included in the sound may become the first diffused noise and the second diffused noise received by the first sound receiving unit 112 and the second sound receiving unit 114, respectively.

The diffused noise may include white noises. For example, the term diffused noise may refer to noise that is non-directional, has a same magnitude in all directions, and has a random phase. As an example, diffused noise may include bubble noises, reverberations, and the like from inside a room (e.g., an office, a café, etc.).

Magnitudes of diffused noises included in sounds received by the first sound receiving unit 112 and the second sound receiving unit 114 may be approximately same as each other, and correlation between the diffused noises may be low. Here, the correlation may be coherence.

In various examples, the diffused noises included in the sounds received by the first sound receiving unit 112 and the second sound receiving unit 114 may have higher correlation in a low frequency band in comparison to a high frequency band. Here, the low frequency band may refer to a frequency band below or equal to about 500 Hz. However, the examples herein are not limited thereto.

There may be a correlation between diffused noises in a low frequency band. Accordingly, the correlation estimating unit 120 may estimate a correlation between diffused noises included in sounds received by the sound receiving units 110. For example, correlation estimating unit 120 may estimate correlation between diffused noises included in sounds received by the sound receiving units 110, such that higher weight is applied to a low frequency band in comparison to a high frequency band. As another example, the correlation estimating unit 120 may estimate correlation using a sinc function according to frequency. Furthermore, the correlation estimating unit 120 may estimate correlation using sinc functions according to frequency and a distance between the sound receiving units 110.

In detail, the correlation estimating unit 120 may estimate correlation between diffused noises by using a sinc function which employs at least one of a distance between the first sound receiving unit 112 and the second sound receiving unit 114 and a frequency as a variable.

However, usage of a sinc function to estimate correlation between diffused noises is merely an example, and the correlation estimating unit 120 may estimate correlation between diffused noises using any of various methods for applying a higher weight to a low frequency band of the diffused noise and applying a lower weight to a high frequency band of the diffused noises.

The spectrum density estimating unit 130 may estimate spectrum density of the diffused noises using the correlation estimated by the correlation estimating unit 120. For example, spectrum density may be power spectrum density (PSD). As another example, the spectrum density may further include energy spectrum density (ESD), and the like.

For example, the spectrum density estimating unit 130 may estimate a spectrum density in which a low frequency band is compensated. As described above, diffused noises included in sounds received by the first sound receiving unit 112 and the second sound receiving unit 114 may have a higher correlation in a low frequency band as compared to a high frequency band, and thus the spectrum density estimating unit 130 may estimate a spectrum density in which a low frequency band is compensated.

Furthermore, the spectrum density estimating unit 130 may estimate a covariance matrix using sounds received by the sound receiving units 110, estimate an eigenvalue of the estimated covariance matrix, and estimate a spectrum density in which a low frequency band is compensated by using correlation between the diffused noises and the estimated eigenvalue.

As described herein, the spectrum density estimating unit 130 does not underestimate spectrum density of diffused noises in a low frequency band, and thus, spectrum density may be estimated accurately with a small amount of calculations.

Figure 2:
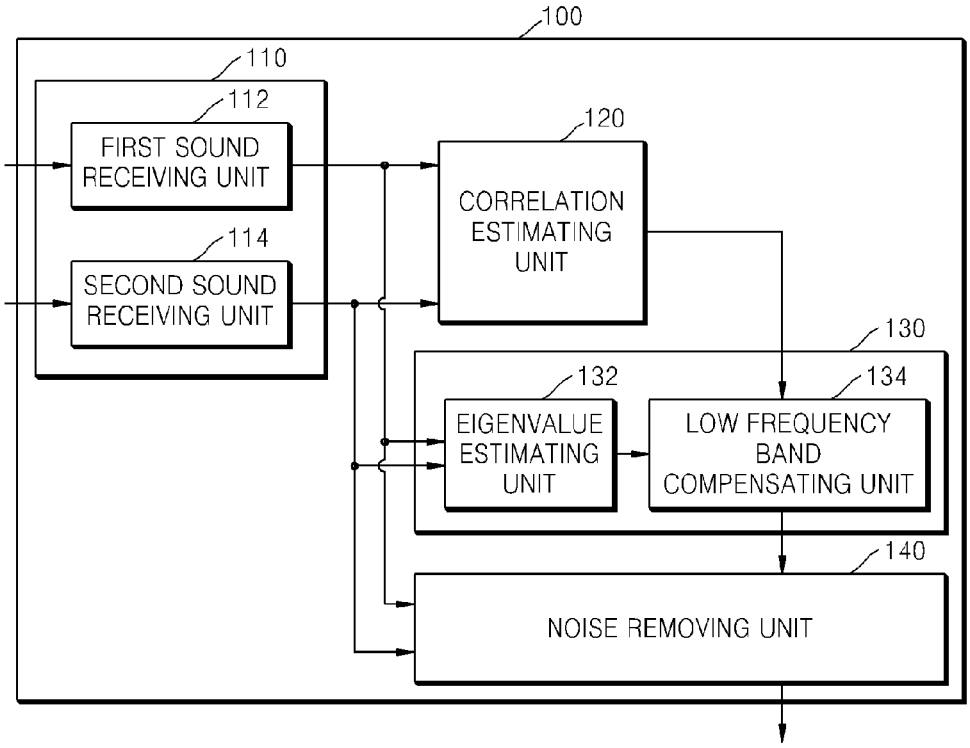
FIG. 2 is another diagram illustrating an example of a processor.

FIG. 2 illustrates another example of the processor 100. Referring to FIG. 2, the processor 100 includes the at least two sound receiving units 110, the correlation estimating unit 120, and the spectrum density estimating unit 130. In this example, the processor 100 also includes a noise removing unit 140. Furthermore, the at least two sound receiving units 110 includes the first sound receiving unit 112 and the second sound receiving unit 114, and the spectrum density estimating unit 130 includes an eigenvalue estimating unit 132 and a low frequency band compensating unit 134.

The processor 100 shown in FIG. 2 is another example of the processor 100 shown in FIG. 1. Therefore, the processor 100 according to the present embodiment is not limited to the units shown in FIG. 2. Furthermore, descriptions applied above with respect to FIG. 1 may also be applied to the processor 100 shown in FIG. 2, and thus repeated descriptions are omitted.

The at least two sound receiving units 110 receive sounds from the surrounding. For example, the sound receiving units 110 may perform a Fourier Transformation or a Fast Fourier Transformation to convert the received sounds to frequency bands.

The correlation estimating unit 120 may estimate correlation between diffused noises that are included in the sounds received by the sound receiving units 110. Hereinafter, an example in which the processor 100 is included in a binaural hearing aid is described. However, the processor 100 is not limited thereto.

The first sound receiving unit 112 and the second sound receiving unit 114 may be attached on the left ear and the right ear of a user, respectively. For example, correlation between diffused noises received by the first sound receiving unit 112 and the second sound receiving unit 114 may be expressed as shown in Equation 1 below.

$$\Psi = \frac{\Gamma_{NN}^{LR}}{\sqrt{\Gamma_{NN}^{L}\Gamma_{NN}^{R}}} = \frac{\Gamma_{NN}^{LR}}{\Gamma_{NN}} \quad \text{[Equation 1]}$$

In Equation 1, $\Psi$ denotes correlation between diffused noises received by the first sound receiving unit 112 and the second sound receiving unit 114, $\Gamma_{NN}$ denotes power spectrum density of the diffused noises, $\Gamma_{NN}^{L}$ denotes power spectrum density of the diffused noises received by the first sound receiving unit 112, $\Gamma_{NN}^{R}$ denotes power spectrum density of the diffused noises received by the second sound receiving unit 114, and $\Gamma_{NN}^{LR}$ denotes power spectrum density of the diffused noises received by the first sound receiving unit 112 and the diffused noises received by the second sound receiving unit 114. In this example, $\Gamma_{NN}^{LR}$ may indicate an average with respect to the diffused noises received by the first sound receiving unit 112 multiplied by the diffused noises received by the second sound receiving unit 114. However, the examples herein are not limited thereto.

In this example, correlation $\Psi$ between diffused noises received by the first sound receiving unit 112 and the second sound receiving unit 114 may be coherence function between the left channel corresponding to the first sound receiving unit 112 and the right channel corresponding to the second sound receiving unit 114. Accordingly, correlation $\Psi$ between diffused noises may be defined as a ratio of power spectrum density $\Gamma_{NN}$ of the diffused noises to power spectrum density $\Gamma_{NN}^{LR}$ of the diffused noises received by the first sound receiving unit 112 and the diffused noises received by the second sound receiving unit 114.

As described herein, diffused noises included in sounds received by the first sound receiving unit 112 and the second sound receiving unit 114 may have a higher correlation in a low frequency band as compared to a high frequency band. Therefore, values of power spectrum density $\Gamma_{NN}^{LR}$ of the diffused noises received by the first sound receiving unit 112 and the diffused noises received by the second sound receiving unit 114 may become closer to zero (0) as frequency increases from a low frequency band to a high frequency band. Accordingly, the correlation estimating unit 120 may estimate correlation, such that higher weight is applied to a low frequency band of diffused noises included in sounds received by the sound receiving units 110 as compared to a high frequency band of diffused noises.

For example, the correlation estimating unit 120 may estimate correlation using a sinc function according to frequency and a distance between the sound receiving units 110. Estimated correlation between diffused noises may be defined as shown in Equation 2 below.

$$\Psi = \mathrm{sinc}\left(\frac{2\pi f d_{LR}}{c}\right) \quad \text{[Equation 2]}$$

In Equation 2, $\Psi$ denotes correlation, f denotes frequency, $d_{LR}$ denotes a distance between the sound receiving units 110, and c denotes the speed of sound.

The correlation estimating unit 120 may estimate correlation between diffused noises using sinc functions according to frequency and a distance between the first sound receiving unit 112 and the second sound receiving unit 114.

The spectrum density estimating unit 130 may estimate spectrum density with respect to the diffused noises by using the correlation with respect to the diffused noises. For example, spectrum density that is estimated by the spectrum density estimating unit 130 may be defined as shown in Equation 3 below.

$$\Gamma_{NN} = \frac{\lambda}{1-\Psi} \quad \text{[Equation 3]}$$

In Equation 3, $\Gamma_{NN}$ denotes power spectrum density of diffused noises, $\lambda$ denotes an eigenvalue of a covariance matrix with respect to sounds received by the sound receiving units, and $\Psi$ denotes correlation between the diffused noises.

As another example, the spectrum density estimating unit 130 may estimate spectrum density with respect to diffused noises by using correlation estimated by the correlation estimating unit 120 and an eigenvalue of a covariance matrix with respect to sounds received by the sound receiving units 110. For example, the eigenvalue estimating unit 132 may estimate an eigenvalue of a covariance matrix by using sounds received by the sound receiving units 110. The low frequency band compensating unit 134 may compensate a low frequency band of spectrum density with respect to diffused noises by using the eigenvalue estimated by the eigenvalue estimating unit 132 and the correlation estimated by the correlation estimating unit 120.

The eigenvalue estimating unit 132 may estimate a covariance matrix as shown in Equation 4 below by using sounds received by the sound receiving units 110.

$$R_x = \begin{bmatrix} |a_L|^2\Gamma_{SS}^2 + \Gamma_{NN} & a_L a_R^* \Gamma_{SS} + \Psi\Gamma_{NN} \\ a_R a_L^* \Gamma_{SS} + \Psi\Gamma_{NN} & |a_R|^2\Gamma_{SS}^2 + \Gamma_{NN} \end{bmatrix} \quad \text{[Equation 4]}$$

In Equation 4, $R_x$ denotes a covariance matrix, $a_R$ denotes a right head related transfer function (HRTF) between a sound signal and a user, $a_L$ denotes a left HRTF between the sound signal and the user, $\Gamma_{SS}$ denotes power spectrum density of a sound signal, $\Gamma_{NN}$ denotes power density spectrum of diffused noises, and $\Psi$ denotes correlation between the diffused noises.

A sound signal may be an input signal input to each of the sound receiving units 110 other than diffused noises. However, the examples herein are not limited thereto.

In Equation 4, a covariance matrix $R_x$ of sounds received by the sound receiving units 110 has elements including $\Psi\Gamma_{NN}$. In other words, the eigenvalue estimating unit 132 further considers $\Psi\Gamma_{NN}$ for estimating a cross correlation function with respect to signals received by the first sound receiving unit 112 and the second sound receiving unit 114. Therefore, the eigenvalue estimating unit 132 may estimate a covariance matrix in consideration of correlation between diffused noises.

Furthermore, the eigenvalue estimating unit 132 may estimate an eigenvalue of a covariance matrix as shown in Equation 5 below.

$$\lambda_{1,2} = \frac{((|a_L|^2 + |a_R|^2)\Gamma_{SS} + 2\Gamma_{NN}) \pm ((|a_L|^2 + |a_R|^2)\Gamma_{SS} + 2\Psi\Gamma_{NN})}{2} \quad \text{[Equation 5]}$$

In Equation 5, $\lambda_{1,2}$ denote eigenvalues of the covariance matrix, $a_R$ denotes a right HRTF between the sound signal and the user, $a_L$ denotes a left HRTF between the sound signal and the user, $\Gamma_{SS}$ denotes power spectrum density of the sound signal, $\Gamma_{NN}$ denotes power spectrum density of diffused noises, and $\Psi$ denotes correlation between diffused noises.

The eigenvalue estimating unit 132 may estimate the smaller one of the eigenvalues $\lambda_1$ and $\lambda_2$ of a covariance matrix estimated according to Equation 5 as an eigenvalue of the covariance matrix. In this example, the low frequency band compensating unit 134 compensates a low frequency band of spectrum density with respect to diffused noises by using the eigenvalue estimated by the eigenvalue estimating unit 132 and the correlation estimated by the correlation estimating unit 120.

For example, the low frequency band compensating unit 134 may estimate a power spectrum density with respect to diffused noises using the eigenvalue estimated by the eigenvalue estimating unit 132 and the correlation estimated by the correlation estimating unit 120, as shown in Equation 3. Accordingly, the estimated spectrum density may be power spectrum density in which a low frequency band is compensated.

As described herein, the spectrum density estimating unit 130 may estimate spectrum density with respect to diffused noises in consideration of correlation between the diffused noises, and thus, accuracy of spectrum density estimation may be improved.

The noise removing unit 140 may remove diffused noises that are included in sounds received by the sound receiving units 110 using the spectrum density estimated by the spectrum density estimating unit 130. For example, the noise removing unit 140 may be a filter for removing diffused noises from sounds received by the sound receiving units 110 using the spectrum density of the diffused noises. However, the examples herein are not limited thereto.

Accordingly, the processor 100 may receive sounds received by the sound receiving units 110 and estimate spectrum density of diffused noises, and thus an amount of calculation performed by the processor 100 is relatively small. Furthermore, because the processor 100 may estimate spectrum density of diffused noises in consideration of correlation between the diffused noises, accuracy of the estimation may be improved, and more particularly, accuracy of estimation with respect to a low frequency band may be significantly improved.

Figure 3:
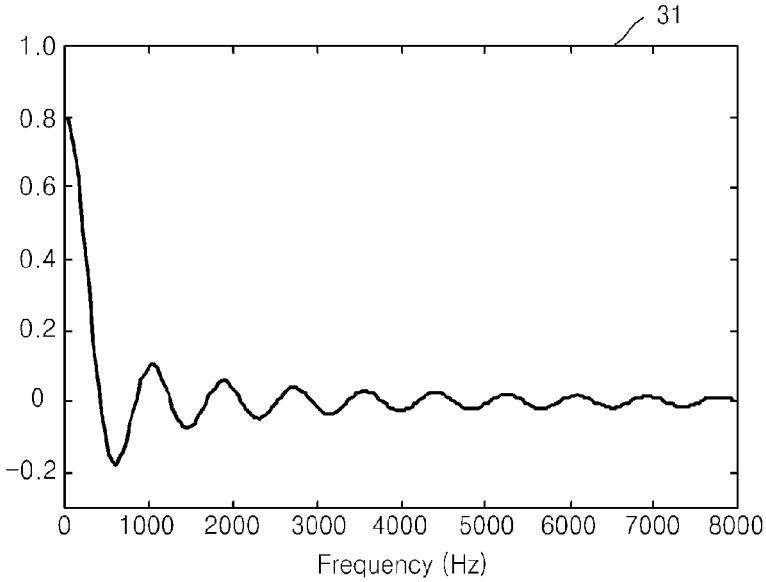
FIG. 3 is a diagram illustrating an example of estimated correlations.

FIG. 3 illustrates an example of estimated correlations. For example, the correlations may be estimated by the correlation estimating unit 120 shown in FIG. 1. Referring to FIG. 3, a graph 31 indicates correlation between diffused noises.

As indicated by the graph 31, diffused noises may have high correlation in a low frequency band (e.g., a band of low frequencies up to 500 Hz) and may have low correlation in a high frequency band. Therefore, the correlation estimating unit 120 may estimate correlation using sinc functions according to frequency and a distance between the sound receiving units 110, as indicated by the graph 31.

Figure 4:
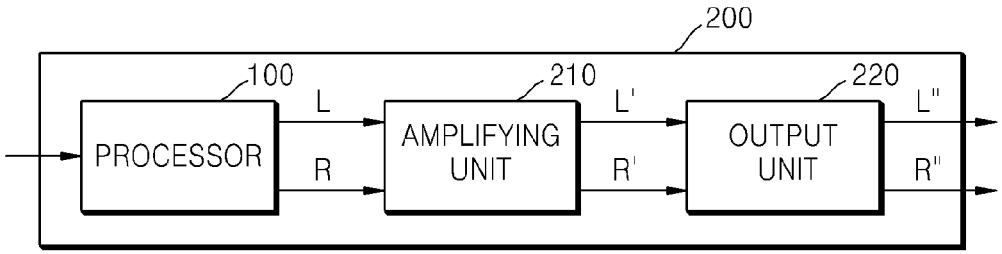
FIG. 4 is a diagram illustrating an example of a sound reproducing device.

FIG. 4 illustrates an example of a sound reproducing device 200. Referring to FIG. 4, the sound reproducing device 200 includes the processor 100, an amplifying unit 210, and an output unit 220. For example, the sound reproducing apparatus may be a terminal, a hearing aid, a sensor, a mobile phone, a computer, and the like.

The sound reproducing device 200 may be binaural hearing aids. However, the examples herein are not limited thereto. Furthermore, the processor 100 shown in FIG. 4 may be the processor 100 shown in FIG. 1 or 2. Therefore, descriptions of the processor 100 applied above with respect to FIGS. 1 and 2 may also be applied to the processor 100 shown in FIG. 4, and thus repeated descriptions are omitted.

The processor 100 receives sounds from the surroundings using at least two sound receiving units, estimates spectrum density with respect to diffused noises included in the received sounds in consideration of correlation between the diffused noises, and removes the diffused noises included in the received sounds using the estimated spectrum density. For example, the estimated spectrum density may be a spectrum density in which a low frequency band is compensated.

The processor 100 may transmit signals L and R to the amplifying unit 210. The signal L and AR may be generated by removing diffused noises from signals received by sound receiving units arranged at the left ear and the right ear of a user.

The amplifying unit 210 may amplify sounds from which diffused noises have been removed by the processor 100. For example, the amplifying unit 210 may transmit amplified signals L' and R' to the output unit 220. The amplified signals L' and R' may be generated by adjusting amplification gains according to frequencies.

The output unit 220 may output sounds amplified by the amplifying unit 210. For example, the output unit 220 may output signals L" and R" which are generated by converting the amplified signals L' and R' to time domains. For example, the output unit 220 may include a conversion processor for converting signals from the frequency domain to the time domain and a speaker for outputting the converted signals.

For example, a user may hear sounds that are generated by removing diffused noises and that are amplified without the diffused noises, by wearing the sound reproducing device 200.

Figure 5:
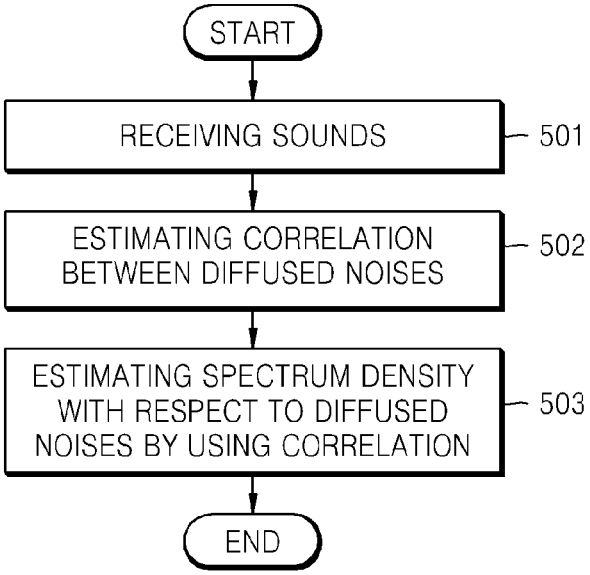
FIG. 5 is a flowchart illustrating an example of a method of estimating spectrum density of diffused noises.

FIG. 5 illustrates an example of a method of estimating spectrum density of diffused noises. For example, the method shown in FIG. 5 may be performed by the processor 100 and the sound reproducing device 200 shown in FIGS. 1, 2, and 4. Therefore, even if omitted below, descriptions applied above with respect to the processor 100 and the sound reproducing device 200 shown in FIGS. 1, 2, and 4 may also be applied to the method shown in FIG. 5.

In 501, sounds are received from the surroundings. For example, the sounds may be received by at least two sound receiving units 110 which may include microphones.

In 502, a correlation between diffused noises included in the sounds received in 501 is estimated.

In 503, spectrum density with respect to the diffused noises is estimated using the correlation estimated in 502. For example, the estimated spectrum density may be a spectrum density in which a low frequency band is compensated.

As described herein, the processor 100 may accurately estimate spectrum density with respect to diffused noises by using a simple algorithm. Accordingly, spectrum density with respect to diffused noises may be accurately estimated with a reduced amount of calculations.

Program instructions to perform a method described herein, or one or more operations thereof, may be recorded, stored, or fixed in one or more computer-readable storage media. The program instructions may be implemented by a computer. For example, the computer may cause a processor to execute the program instructions. The media may include, alone or in combination with the program instructions, data files, data structures, and the like. Examples of computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions, that is, software, may be distributed over network coupled computer systems so that the software is stored and executed in a distributed fashion. For example, the software and data may be stored by one or more computer readable storage mediums. Also, functional programs, codes, and code segments for accomplishing the example embodiments disclosed herein can be easily construed by programmers skilled in the art to which the embodiments pertain based on and using the flow diagrams and block diagrams of the figures and their corresponding descriptions as provided herein. Also, the described unit to perform an operation or a method may be hardware, software, or some combination of hardware and software. For example, the unit may be a software package running on a computer or the computer on which that software is running.

As a non-exhaustive illustration only, a terminal/device/unit described herein may refer to mobile devices such as a cellular phone, a personal digital assistant (PDA), a digital camera, a portable game console, and an MP3 player, a portable/personal multimedia player (PMP), a handheld e-book, a portable laptop PC, a global positioning system (GPS) navigation, a tablet, a sensor, and devices such as a desktop PC, a high definition television (HDTV), an optical disc player, a setup box, a home appliance, and the like that are capable of wireless communication or network communication consistent with that which is disclosed herein.

A computing system or a computer may include a microprocessor that is electrically connected with a bus, a user interface, and a memory controller. It may further include a flash memory device. The flash memory device may store N-bit data via the memory controller. The N-bit data is processed or will be processed by the microprocessor and N may be 1 or an integer greater than 1. Where the computing system or computer is a mobile apparatus, a battery may be additionally provided to supply operation voltage of the computing system or computer. It will be apparent to those of ordinary skill in the art that the computing system or computer may further include an application chipset, a camera image processor (CIS), a mobile Dynamic Random Access Memory (DRAM), and the like. The memory controller and the flash memory device may constitute a solid state drive/disk (SSD) that uses a non-volatile memory to store data.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A processor device comprising:

at least two sound receiving units configured to receive sounds;

a correlation estimating unit configured to estimate a correlation between diffused noises included in the sounds received by the at least two sound receiving units; and a spectrum density estimating unit configured to estimate a spectrum density with respect to the diffused noises based on the estimated correlation, wherein the spectrum density estimating unit comprises:

an eigenvalue estimating unit configured to estimate an eigenvalue of a covariance matrix based on the sound received by the at least two sound receiving units; and a low frequency band compensating unit configured to compensate a low frequency band of spectrum density with respect to the diffused noises based on the estimated eigenvalue and the estimated correlation.

2. The processor device of claim 1, wherein the covariance matrix comprises elements including the estimated correlation multiplied by a power spectrum density of the diffused noises.

3. The processor device of claim 1, wherein the correlation estimating unit estimates the correlation between the diffused noises such that a higher weight is applied to a low frequency band of the diffused noises in comparison to a high frequency band of the diffused noises.

4. The processor device of claim 1, wherein the correlation estimating unit is configured to estimate the correlation using a sinc function according to a frequency.

5. The processor device of claim 4, wherein the correlation estimating unit is configured to estimate the correlation using sinc functions according to the frequency and a distance between the at least two sound receiving units.

6. The processor device of claim 1, further comprising a noise removing unit configured to remove the diffused noises included in the sounds received by the at least two sound receiving units using the estimated spectrum density.

7. A sound reproducing device comprising:

a processor device configured to receive sounds using at least two sound receiving units, estimate a spectrum density with respect to diffused noises included in the received sounds in consideration of a correlation between the diffused noises, wherein estimating the spectrum density with respect to the diffused noises comprises estimating an eigenvalue of a covariance matrix using the sounds received by the at least two sound receiving units, and compensating a low frequency band of spectrum density with respect to the diffused noises based on the estimated eigenvalue and the estimated correlation, and remove the diffused noises included in the received sounds based on the estimated spectrum density;

an amplifying unit configured to amplify signals representative of sounds from which the diffused noises are removed; and an output unit configured to output the amplified sounds.

8. The sound reproducing device of claim 7, wherein the sound reproducing device is a binaural hearing aid.

9. A method for estimating spectrum density of diffused noises, comprising:

receiving sounds using at least two sound receiving units of a processor device;

estimating, using the processor device, a correlation between diffused noises included in the sounds received by the two sound receiving units; and estimating, using the processor device, a spectrum density with respect to the diffused noises based on the estimated correlation, wherein estimating the spectrum density with respect to the diffused noises comprises:

estimating an eigenvalue of a covariance matrix using the sounds received by the at least two sound receiving units; and compensating a low frequency band of spectrum density with respect to the diffused noises based on the estimated eigenvalue and the estimated correlation.

10. The method of claim 9, wherein the covariance matrix comprises elements including the estimated correlation multiplied by power spectrum density of the diffused noises.

11. The method of claim 9, wherein the estimating of the correlation comprises estimating the correlation between the diffused noises included in the sounds received by the at least two sound receiving units, such that a higher weight is applied to a low frequency band of the diffused noises in comparison to a high frequency band of the diffused noises.

12. The method of claim 11, wherein the estimating of the correlation comprises estimating the correlation using a sinc function according to a frequency.

13. The method of claim 11, wherein the estimating of the correlation comprises estimating the correlation using sinc functions according to the frequency and a distance between the at least two sound receiving units.

14. The method of claim 9, further comprising removing the diffused noises included in the sounds received by the at least two sound receiving units using the estimated spectrum density.

15. A non-transitory computer-readable storage medium having stored therein program instructions configured to cause a computer to execute a method for estimating spectrum density of diffused noises using a processor device that has at least two sound receiving units, the method comprising:

receiving sounds using the at least two sound receiving units;

estimating, using a processor device, a correlation between diffused noises included in the sounds received by the two sound receiving units; and estimating, using the processor device, a spectrum density with respect to the diffused noises based on the estimated correlation, wherein estimating the spectrum density with respect to the diffused noises comprises:

estimating an eigenvalue of a covariance matrix using the sounds received by the at least two sound receiving units; and compensating a low frequency band of spectrum density with respect to the diffused noises based on the estimated eigenvalue and the estimated correlation.

* * * * *